US008219269B2

(12) United States Patent
Ichikawa et al.

(10) Patent No.: US 8,219,269 B2
(45) Date of Patent: Jul. 10, 2012

(54) CONTROL APPARATUS FOR MARINE PROPULSION UNIT

(75) Inventors: Noriyoshi Ichikawa, Shizuoka (JP); Masaru Suzuki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 602 days.

(21) Appl. No.: 12/485,070

(22) Filed: Jun. 16, 2009

(65) Prior Publication Data

US 2009/0319106 A1 Dec. 24, 2009

(30) Foreign Application Priority Data

Jun. 24, 2008 (JP) ..... 2008-164991

(51) Int. Cl.
*F02N 11/08* (2006.01)
*B63H 21/00* (2006.01)

(52) U.S. Cl. ..... 701/21; 701/113; 701/114; 701/99; 440/85

(58) Field of Classification Search ..... 701/21
See application file for complete search history.

(56) References Cited

U.S. PATENT DOCUMENTS 4,131,098 A * 12/1978 Daniels et al. ..... 123/406.13
4,159,467 A * 6/1979 Ballin ..... 307/10.5
4,683,859 A * 8/1987 Tamura et al. ..... 123/491
5,252,861 A * 10/1993 Steeby et al. ..... 307/10.6
5,713,338 A * 2/1998 Wheeler ..... 123/640
6,590,396 B1 * 7/2003 Zur et al. ..... 324/433
6,626,154 B1 * 9/2003 Kanno ..... 123/486
7,078,829 B2 * 7/2006 Hunninghaus et al. ..... 307/10.6
7,085,646 B2 * 8/2006 Tanaka et al. ..... 701/113
7,176,588 B2 * 2/2007 Yahagi et al. ..... 307/10.6
7,216,617 B2 * 5/2007 Tanaka et al. ..... 123/179.3
2005/0275988 A1 * 12/2005 Hunninghaus et al. ..... 361/92
2006/0080026 A1 * 4/2006 Tanaka et al. ..... 701/113
2006/0080027 A1 * 4/2006 Tanaka et al. ..... 701/113
2006/0082316 A1 * 4/2006 Yahagi et al. ..... 315/73
2008/0212254 A1 * 9/2008 Arndt et al. ..... 361/194

FOREIGN PATENT DOCUMENTS

JP 06-213112 A 8/1994

* cited by examiner

*Primary Examiner* — Shelley Chen
(74) *Attorney, Agent, or Firm* — Keating & Bennett, LLP

(57) ABSTRACT

A control apparatus for a marine propulsion unit, which can activate an engine even when a computer system in an engine control unit is reset, includes a computer system arranged to actuate a starter motor using power from a battery on a hull in order to activate an engine, a reset state detection device arranged to detect a reset state of the computer system when the computer system is reset, and an analog circuit arranged to actuate the starter motor for a predetermined time period to activate the engine once the reset state is detected by the reset state detection device.

4 Claims, 5 Drawing Sheets

CONTROL APPARATUS FOR MARINE PROPULSION UNIT

BACKGROUND OF THE INVENTION

1. Field of the Invention

The present invention relates to a control apparatus for a marine propulsion unit, and more specifically, relates to a control apparatus for a marine propulsion unit that is preferably equipped with an engine control unit using a computer system in an outboard motor and is arranged to actuate a starter motor via the engine control unit with power from a battery on a hull to activate an engine.

2. Description of the Related Art

An outboard motor is generally disposed at the stern of a hull and a control compartment is provided in the front portion of the hull. An engine of the outboard motor is activated by remote operation of a switch panel that is provided in the control compartment. When the hull is large in size, the control compartment and the outboard motor are located remote from each other. Thus, it is difficult for an operator to recognize the engine sound, and the operator may keep actuating the starter motor even after the activation of the engine. In JP-A-Hei 6-213112, when an engine control unit that uses a computer system such as a microcomputer is installed in the outboard motor, the engine control unit controls actuation of the starter motor to activate the engine. According to this background art, because the computer system monitors the activation of the engine, it is possible to avoid continuous actuation of the starter motor after the engine start.

However, the computer system such as a microcomputer that is installed in the engine control unit is reset when supplied voltage thereto is lowered below a predetermined value. The term "reset" means that the computer system terminates the output in order to hold its own functions. Once the supplied voltage is restored to the predetermined value or greater, the reset is cancelled to recover the computer system. Generally, the outboard motor is not equipped with its own battery. Thus, the starter motor and the computer system for the engine control unit are actuated with power from the battery on the hull. However, when the hull is large in size, a cable that connects the battery and the outboard motor tends to be long. Therefore, even when a cable with low resistance per unit length is used, a voltage drop that is caused by resistance of the cable is unavoidable. Especially, the engine and its inertia force that acts on a watercraft are large in the large watercraft, and thus a large amount of power is required to actuate the starter motor. Consequently, there is a possibility that the supplied voltage from the battery may become lower than the reset voltage of the computer system. Once the supplied voltage becomes lower than the reset voltage of the computer system, the computer system is reset, and the starter motor stops. Thus, the engine cannot be activated.

SUMMARY OF THE INVENTION

In view of the above problems, preferred embodiments of the present invention provide a control apparatus for a marine propulsion unit that can activate an engine even when a computer system is reset.

A control apparatus for a marine propulsion unit in which a computer system actuates a starter motor with power from a battery on a hull to activate an engine includes a reset state detector arranged to detect a reset state of the computer system upon reset thereof and an analog circuit arranged to actuate the starter motor for a predetermined time period to activate the engine once the reset state of the computer system is detected.

In the control apparatus for a marine propulsion unit, once the computer system is reset, the reset state thereof is detected, and then the analog circuit actuates the starter motor for the predetermined time period to activate the engine. Therefore, even in a case that the hull of a watercraft is large in size, that a power-supply cable from the battery is long, and that the computer system is reset due to a drop in supplied voltage during actuation of the starter motor, the engine can reliably be activated.

Also, in the control apparatus for a marine propulsion unit, the analog circuit preferably includes a timer to count the predetermined time period, outputs a signal to actuate the starter motor at a moment when the computer system is changed from a non-reset state to a reset state, and starts the timer at the same moment. After the predetermined time period has elapsed, the timer stops outputting the driving signal for the starter motor.

In this control apparatus for a marine propulsion unit, the analog circuit outputs the driving signal for the starter motor and starts the timer at the moment when the computer system is changed from the non-reset state to the reset state. Then, after the predetermined time period has elapsed, the timer stops outputting the driving signal for the starter motor. Therefore, even when the computer system remains in the reset state, the starter motor will not be driven continuously.

In the control apparatus for a marine propulsion unit, when the computer system is in the non-reset state, the computer system actuates the starter motor to activate the engine.

In this control apparatus for a marine propulsion unit, even when the supplied voltage drops, and thus the computer system is reset, the analog circuit actuates the starter motor. Therefore, the supplied voltage and the computer system can be recovered. After recovery, the computer system actuates the starter motor to reliably activate the engine.

In the control apparatus for a marine propulsion unit, a cut-off switch is arranged to cut off a drive circuit of the starter motor in a case that the drive circuit of the starter motor is short-circuited and that current keeps flowing through the starter motor.

In this control apparatus for a marine propulsion unit, even when the drive circuit of the starter motor is short-circuited, the cut-off switch cuts off the drive circuit of the starter motor. Therefore, it is possible to avoid continuous flow of the current through the starter motor.

If the computer system is reset, and the reset state is detected when a computer system actuates a starter motor with power from a battery on a hull to activate an engine, the analog circuit actuates the starter motor for the predetermined time period to activate the engine. Therefore, even in a case that the hull of a watercraft is large in size, that a power-supply cable from the battery is long, and that the computer system is reset due to a drop in supplied voltage during actuation of the starter motor, the engine can reliably be activated.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

A description will hereinafter be made of preferred embodiments of a control apparatus for a marine propulsion unit according to the present invention with reference to the drawings.

Figure 1:
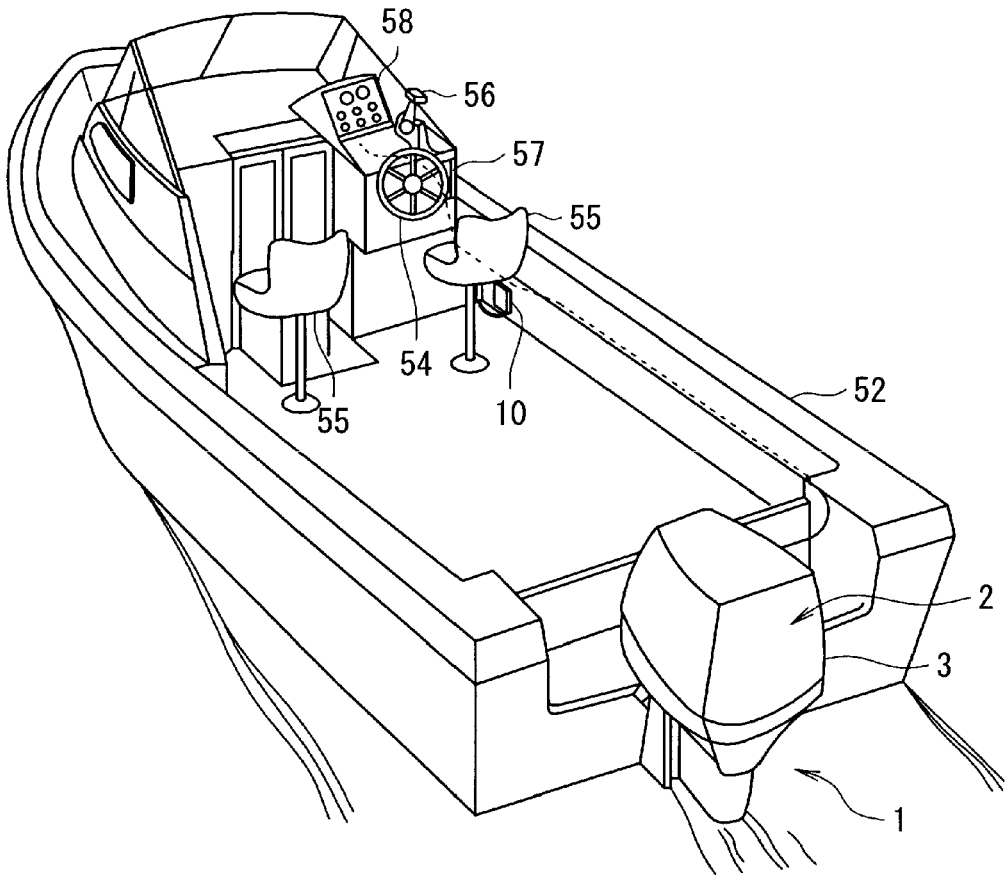
FIG. 1 is a schematic view of a preferred embodiment of a watercraft in which a control apparatus for a marine propulsion unit is installed.

FIG. 1 is a schematic view of a watercraft in which a control apparatus for a marine propulsion unit in this preferred embodiment is installed. This watercraft has an outboard motor 1 that is mounted to the stern of an open-deck hull 52 and includes, at its front portion, a control compartment in which a steering wheel 54, seats 55, a remote control lever 56, a switch panel 57 that includes a main switch and a start switch, an instrument panel 58, and the like are disposed. The outboard motor 1 includes therein an engine control unit to control an engine disposed in a cowl, which will be described below. Also, a remote control unit for remote control of the outboard motor 1 is disposed in the switch panel 57, and the remote control unit is connected to the engine control unit by a cable. In addition, an immobilizer receiver 10 that receives an authentication code from a so-called transponder (transmitter or repeater) is mounted on a vertical or nearly vertical surface below the control compartment, which is a sidewall of a hull 52, and is connected to the remote control unit in the switch panel 57 by a cable.

Figure 2:
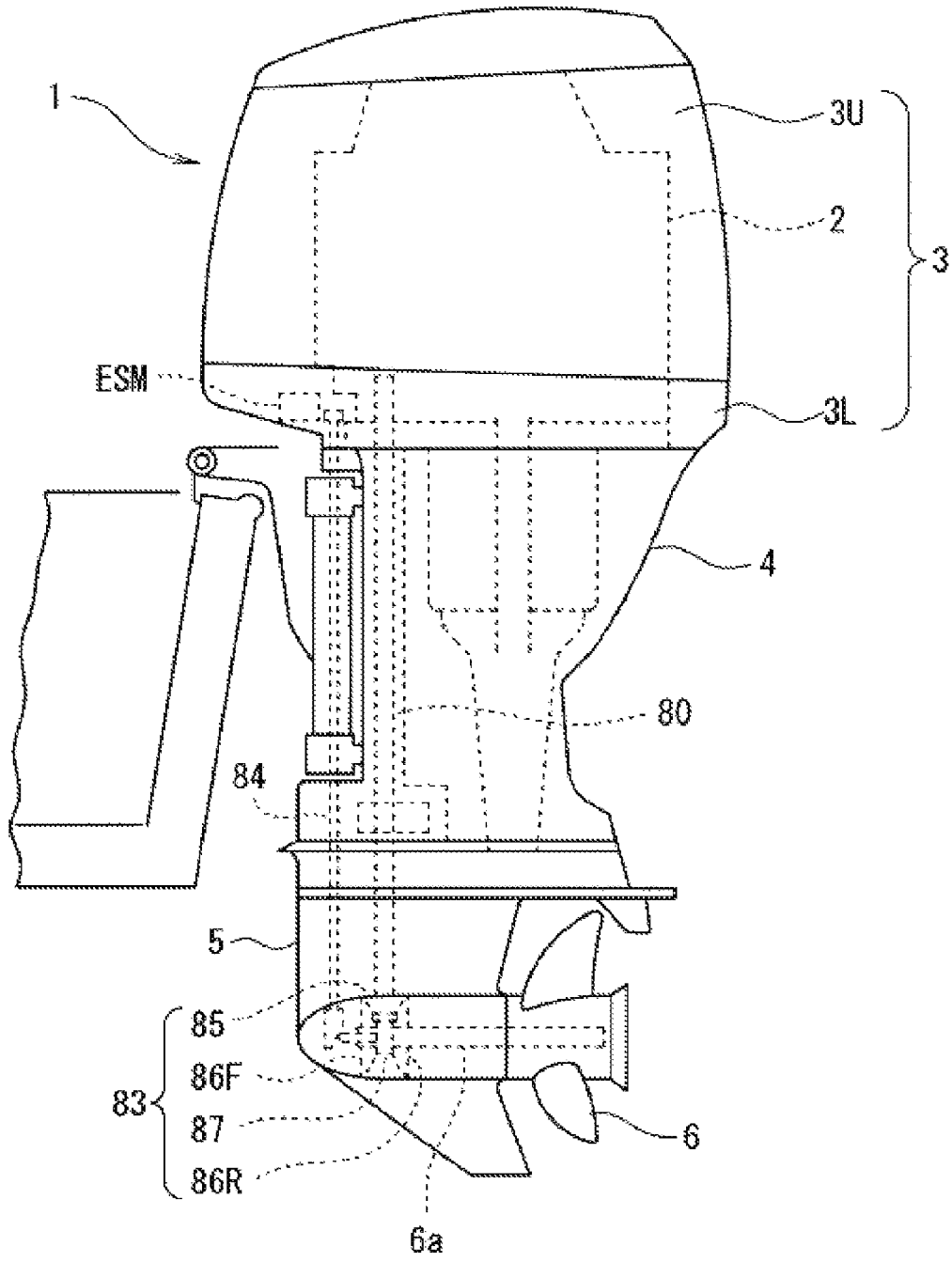
FIG. 2 is an external view of an outboard motor used for the watercraft in FIG. 1.

As shown in FIG. 2, the outboard motor 1 preferably includes a cowl 3, an upper case 4, and a lower case 5. The outboard motor 1 is mounted to the hull 52 by a clamp (not shown) for vertical and transverse pivotal movement relative to the hull 52. The cowl 3 preferably includes an upper cowl 3U and a lower cowl 3L and also includes therein an engine 2.

A propeller shaft 6*a* as a rotary shaft of a propeller 6 is inserted in the lower case 5 in a horizontal direction. A drive shaft 80 that extends from the inside of the cowl 3 to the inside of the lower case 5 is connected at its lower end to the propeller shaft 6*a* via a shift change mechanism 83 that preferably includes a driver gear 85 including bevel gears, a forward gear 86F, a reverse gear 86R, and a dog clutch 87. Then, a shift rod 84 that is vertically disposed in parallel or substantially in parallel with the drive shaft 80 is rotated by an electrical rotary mechanism ESM that includes an electric motor controlled by an electrical controlled unit (not shown). Consequently, the shift change mechanism 83 is actuated to make a shift change to neutral, forward, or reverse, and the rotary force of the drive shaft 80 is subsequently transmitted to the propeller shaft 6*a*.

In other words, in the shift change mechanism 83, the forward gear 86F and the reverse gear 86R, both of which are rotatably disposed on the propeller shaft 6*a*, are engaged with the drive gear 85 that is fixed to the lower end of the drive shaft 80. The dog clutch 87, which is disposed on the propeller shaft 6*a* so as to be slidable but not rotatable relative thereto, is disposed between the forward gear 86F and the reverse gear 86R. In addition, the dog clutch 87 is slid on the propeller shaft 6*a* in conjunction with the rotation of the shift rod 84 (rotation of a cam surface at the lower end of the shift rod).

In the shift change mechanism 83 as described above, the shift rod 84 is rotated about its axis by the electrical rotary mechanism ESM, thereby moving the dog clutch 87 either for engagement with one of the forward gear 86F and the reverse gear 86R to transmit the rotation of the drive shaft 80 to the propeller shaft 6*a* via the respective gear, or to an intermediate position between the forward gear 86F and the reverse gear 86R to prevent engagement with any of the gears so that the outboard motor 1 is brought into a neutral state in which the rotation of the drive shaft 80 is not transmitted to the drive shaft 6*a*.

A battery on the hull 52 is connected to the outboard motor 1 via a battery switch (not shown) and a battery cable (not shown), and power from the battery is supplied to electrical components and the engine control unit of the outboard motor 1. In addition, the outboard motor 1 is connected to the hull 52 by a remote control cable and a throttle shift cable. In this preferred embodiment, the engine control unit for the outboard motor 1 is installed in the outboard motor 1 and connected to the remote control unit in the switch panel 57 with a remote control cable. As described above, the remote control unit in the switch panel 57 is connected to the immobilizer receiver 10. Therefore, by transmitting the authentication result of the authentication code received by the immobilizer receiver 10 to the engine control unit, various settings after the authentication can be made with the engine control unit. In this preferred embodiment, the activation of the engine 2 in the outboard motor 1 is permitted when the authentication code is authenticated by the immobilizer receiver 10. In addition, the engine 2 is activated only when the switch panel 57 outputs an engine activation command after the authentication of the code. The specification after the authentication of the code is not limited to the above, and may include use of the battery switch or cancellation of a shift lock of the shift change mechanism.

Figure 3:
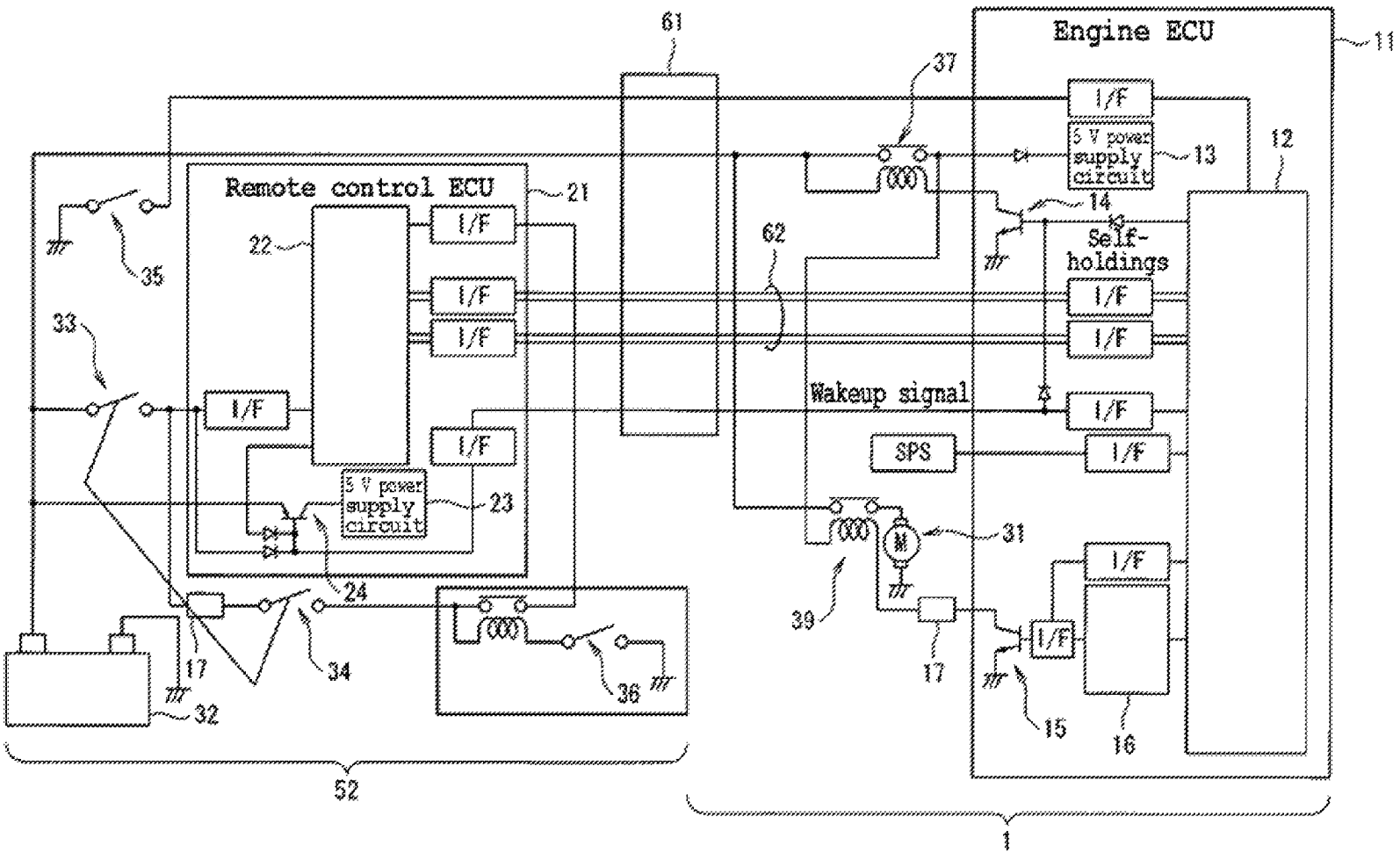
FIG. 3 is a block diagram of an engine control circuit and a remote control circuit that are installed in the watercraft in FIG. 1.

FIG. 3 shows detailed connecting states of an engine control unit 11 (engine ECU in FIG. 3) of this preferred embodiment, a remote control unit 21 (remote control ECU in FIG. 3), a starter motor 31, a battery 32, and the like. The reference symbol "I/F" in the drawing denotes an interface that performs necessary conversion between the components. Also, the reference symbol "SPS" in the drawing denotes a shift position sensor that detects a shift state by the shift change mechanism 83. In this case, the shift position sensor detects the neutral state of the shift and outputs the state to the engine control unit 11. The engine control unit 11 is connected to the remote control unit 21 by an individual cable 61 called an extension harness. Accordingly, the right side of the drawing relative to the cable 61 is the outboard motor 1 side while the left side thereof is the hull 52 side.

The engine control unit 11 and the remote control unit 21 respectively include computer systems 12, 22 such as a microcomputer, microprocessor, or other suitable computing device. The computer systems 12, 22 are directly connected to each other by, for example, four signal wires 62 in the cable 61 so as to exchange necessary information therebetween. Both of the computer systems 12, 22 are activated by 5-volt DC. Thus, the engine control unit 11 and the remote control unit 21 respectively include 5-volt power supply circuits 13, 23 that convert a direct voltage from the battery 32 to 5-volt DC. The computer systems 12, 22 are brought into a so-called reset state in which the computer systems 12, 22 terminate the output when the supplied voltage thereto becomes approximately 6 volts, for example. During the reset state, a high-level reset signal RST is output.

The reference numeral 33 in the drawing denotes a main switch for main power source of the system, and the reference numeral 34 denotes a start switch to activate the engine 2 by the starter motor 31. The main switch 33 and the start switch 34 are synchronously opened and closed by a switch (not shown) on the switch panel 57. The reference numeral 35 in the drawing denotes a stop switch that is generally called an engine stop switch and is also provided on the switch panel 57. When the stop switch (engine stop switch) 35 is closed, the engine 2 is forcibly deactivated. In addition, the reference numeral 36 in the drawing denotes a lever position sensor to detect the state of a remote control lever.

In a case that the engine stop switch 35 is open, that the shift position is neutral, and that the lever position sensor 36 detects the neutral position, if the main switch 33 and the start switch 34 are closed, a power-switching element 24 of the remote control unit 21 is activated, 5-volt DC is generated by the 5-volt power supply circuit 23, a wakeup signal is output from the remote control unit 21. Accordingly, a power-switching element 14 of the engine control unit 11 is activated to close a main relay 37, and 5-volt DC is generated by the 5-volt power supply circuit 13 of the engine control unit 11.

When the lever position sensor 36 detects the neutral position, the output of the start switch 34 is input to the remote control unit 21. Thus, the computer system 22 of the remote control unit 21 receives an input indicating that the remote control lever is in neutral. The computer system 22 of the remote control unit 21 transmits the information that the remote control lever is in neutral to the computer system 12 of the engine control unit 11 via the signal wires 62. The computer system 12 of the engine control unit 11 outputs a drive signal to a start switching element 15 only when the neutral state of the shift switch matches the neutral state of the shift position sensor SPS. A starter relay 39 that is connected to a position downstream of the main relay 37 is closed by the start switching element 15 to which the drive signal is input. Accordingly, the current flows to the starter motor 31 for actuation, and thus the engine 2 is activated.

Figure 4:
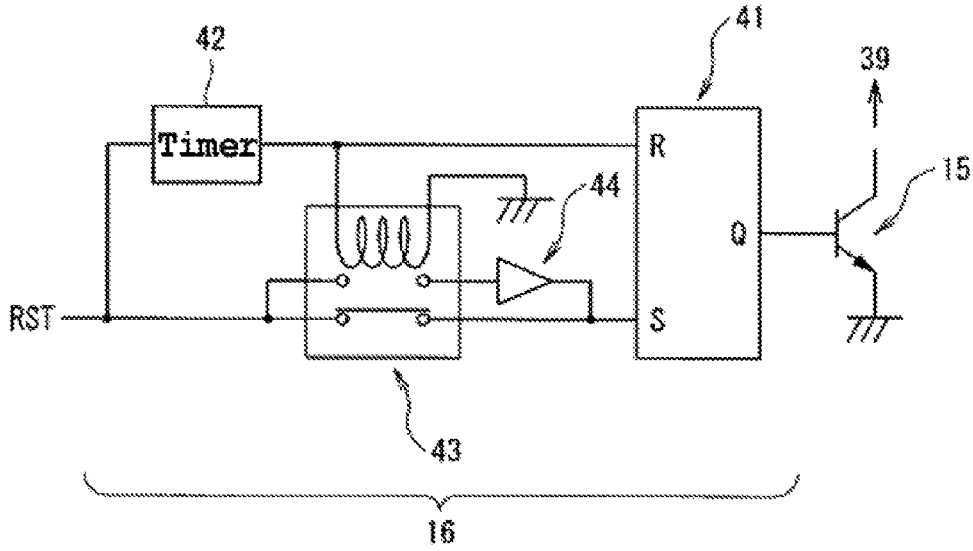
FIG. 4 is a block diagram of a start analog circuit in FIG. 3.

What has been described above is a regular actuation method of the starter motor 31, that is, the flow of the engine activation. In this preferred embodiment, a start analog circuit 16 is interposed between the base of the start switching element 15 and the computer system 12 as a countermeasure against the reset of the computer system 12 of the engine control unit 11. As shown in FIG. 4, the start analog circuit 16 preferably includes a well-known timer switch circuit using a flip-flop circuit 41 of an RS-type and a timer 42. More specifically, an output terminal Q of the flip-flop circuit 41 is connected to the base of the start switching element 15. A set terminal S of the flip-flop circuit 41 is connected to a reset signal output terminal of the computer system 12. A relay 43 is interposed between the start switching element 15 and the computer system 12. A reverser 44 is interposed between a switching side output terminal of the relay 43 and the set terminal S of the flip-flop circuit 41. Meanwhile, one end of the timer 42 is connected to a reset terminal R of the flip-flop circuit 41, and an input terminal the other end of the timer 42 is connected to the reset signal output terminal of the computer system 12. A coil of the relay 43 is connected to an output terminal of the timer 42. It should be noted that the configuration of the start analog circuit 16 is merely an example, and thus the configuration of the circuit is not limited to the above.

The timer 42 starts at the rising edge of the reset signal and out puts a high-level signal after a predetermined time period has elapsed. Transition of the computer system 12 from the non-reset state to the reset state is detected at the rising edge of the reset signal. Accordingly, when the computer system 12 is brought into the reset state, and the reset signal becomes the high-level signal, the high-level reset signal is input to the set terminal of the flip-flop circuit 41. Then, the starter relay 39, which is connected to the position downstream of the main relay 37, is closed by the start switching element 15, which is connected to the output terminal Q of the flip-flop circuit 41. Consequently, the current flows into the starter motor 31 to activate thereof. When the above state is maintained for the predetermined time period, and the engine 2 is activated, for example. Subsequently, the output terminal of the timer 42, that is, the reset terminal R of the flip-flop circuit 41 turns into high level, and the set terminal S of the flip-flop circuit 41 turns into low level by switching of the relay 43. Accordingly, the output terminal Q of the flip-flop circuit 41 turns into the low level, and the starter motor 31 stops.

Figure 5:
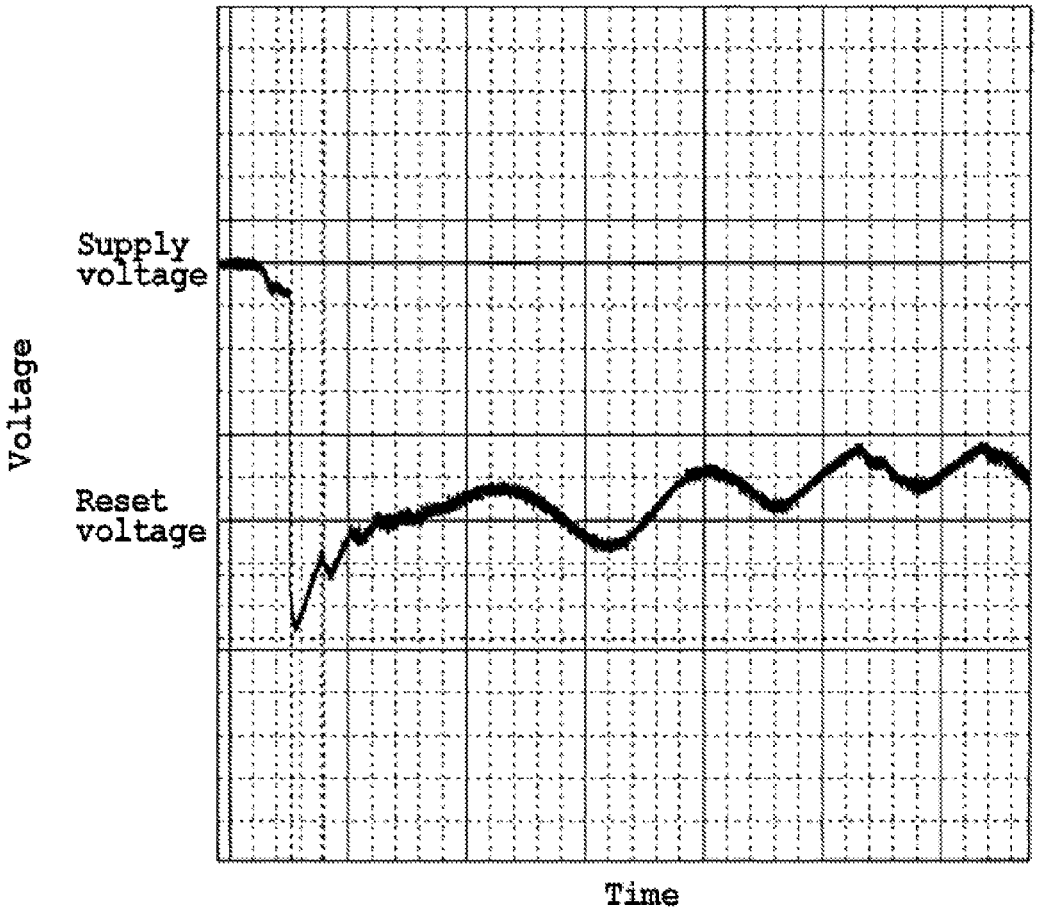
FIG. 5 is a timing chart that indicates the temporal change of supplied voltage at the time of cranking.

FIG. 5 shows the temporal change of supplied voltage at the activation of the engine, that is, so-called cranking. Reset voltage in the drawing indicates the reset voltage of the computer system 12. When the hull 52 is large in size, the length of the cable 61 that connects the battery 32 on the hull 52 to the outboard motor 1 becomes long. Thus, even if the cable 61 with small resistance per unit length is used, a drop in voltage is unavoidable. Consequently, the supplied voltage to the outboard motor 1, that is, to the computer system 12 may become lower than the reset voltage, possibly bringing the computer system 12 into the reset state. However, in this preferred embodiment, even when the computer system 12 is brought into the reset state, cranking is maintained by the start analog circuit 16. Then, the engine 2 is activated by the start analog circuit 16 or the computer system 12 that is recovered along with the recovery of the supplied voltage.

As described above, according to the control apparatus for a marine propulsion unit, in a case that the power of the battery 32 on the hull 32 is used so that the computer system 12 actuates the starter motor 31 for the activation of the engine, when the computer system 12 is reset, the reset state of the computer system 12 is detected, and then the start analog circuit 16 actuates the starter motor 31 for the predetermined time period to activate the engine 2. Therefore, even in a case that the hull 52 of a watercraft is large in size, that the power-supply cable 61 from the battery 32 is long, and that the computer system 12 is reset due to a drop in the supplied voltage during the actuation of the starter motor 31, the engine 2 can reliably be activated.

The start analog circuit 16 is preferably arranged to output the driving signal for the starter motor 31 and starts the timer 42 at the moment when the computer system 12 is changed from the non-reset state to the reset state. Then, after the predetermined time period has elapsed, the timer 42 stops the output of the driving signal for the starter motor 31. Therefore, even when the computer system 12 remains in the reset state, the starter motor 31 will not be driven continuously.

When the computer system 12 is in the non-reset state, instead of the start analog circuit 16, the computer system 12 is preferably arranged to actuate the starter motor 31 in order to activate of the engine. Therefore, even when the supplied voltage drops, and the computer system 12 is reset, the starter motor is actuated by the start analog circuit 16. Thus, with the rotation of the engine 2, that is, with the decrease in inertia, the supplied voltage is recovered. After the recovery of the supplied voltage, the computer system 12 actuates the starter motor 31 to reliably activate the engine.

In the control apparatus for a marine propulsion unit in this preferred embodiment, a cut-off switch 17 that is cut off with the overcurrent, for example, is disposed in a position upstream of the start switch 34 and down stream of the starter relay 39. The cut-off switch 17 cuts off the drive circuit of the starter motor 31 when the drive circuit of the starter motor 31 is short-circuited, and thus, the current keeps flowing through the starter motor 31. The continuous flow of the current through the starter motor 31 is avoided with the cut-off switch 17. Therefore, it is possible to protect the starter motor 31.

An outboard motor to which a control apparatus for a marine propulsion unit according to the present invention is applied is not limited to the one described in the above preferred embodiment. Similarly, a watercraft to which the control apparatus for a marine propulsion unit according to the present invention is applied is not limited to the one described in the above preferred embodiment.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A control apparatus for a marine propulsion unit, the control apparatus comprising:

a computer system arranged to actuate a starter motor using power from a battery on a hull in order to activate an engine;

a reset state detection device arranged to detect a reset state of the computer system when the computer system is reset; and an analog circuit arranged to actuate the starter motor for a predetermined time period to activate the engine once the reset state is detected by the reset state detection device.

2. The control apparatus for a marine propulsion unit according to claim 1, wherein the analog circuit includes a timer arranged to count a predetermined time period and is arranged to output a drive signal for the starter motor and start the timer when the computer system is changed from a non-reset state to a reset state, and the timer stops outputting the driving signal for the starter motor after the predetermined time period has elapsed.

3. The control apparatus for a marine propulsion unit according to claim 1, wherein the computer system is arranged to actuate the starter motor to activate the engine when the computer system is in the non-reset state.

4. The control apparatus for a marine propulsion unit according to claim 1, wherein a cut-off switch is arranged to cut off a drive circuit of the starter motor when the drive circuit of the starter motor is short-circuited and electric current keeps flowing through the starter motor.

* * * * *